US010743730B2

(12) United States Patent
Chao

(10) Patent No.: US 10,743,730 B2
(45) Date of Patent: Aug. 18, 2020

(54) SPRAY MODULE AND ROBOT FOR USE THEREWITH

(71) Applicant: HOBOT TECHNOLOGY INC., Hsinchu County (TW)

(72) Inventor: Chi Mou Chao, Hsinchu County (TW)

(73) Assignee: HOBOT TECHNOLOGY INC., Hsinchu County (TW)

( * ) Notice: Subject to any disclaimer, the term of this patent is extended or adjusted under 35 U.S.C. 154(b) by 0 days.

(21) Appl. No.: 16/048,991

(22) Filed: Jul. 30, 2018

(65) Prior Publication Data

US 2019/0365166 A1 Dec. 5, 2019

(30) Foreign Application Priority Data

May 29, 2018 (CN) ..... 2018 1 0530376

(51) Int. Cl.
*A47L 1/02* (2006.01)

(52) U.S. Cl.
CPC ..... *A47L 1/02* (2013.01); *A47L 2201/06* (2013.01); *A47L 2601/02* (2013.01); *A47L 2601/17* (2013.01)

(58) Field of Classification Search
CPC .... A47L 1/02; A47L 2201/06; A47L 2601/02; A47L 2601/17
USPC ..... 134/95.3, 186, 198
See application file for complete search history.

(56) References Cited

U.S. PATENT DOCUMENTS

| | | | | |
|---|---|---|---|---|
| 5,699,576 | A | 12/1997 | Sohaiby | |
| 9,084,519 | B2 | 7/2015 | Chao | |
| 9,896,139 | B2 | 2/2018 | Chao | |
| 2017/0049288 | A1* | 2/2017 | Knutson | A47L 11/4011 |

FOREIGN PATENT DOCUMENTS

| | | | |
|---|---|---|---|
| CN | 203244339 | U | 10/2013 |
| CN | 107149437 | A | 9/2017 |
| CN | 207341709 | U | 11/2018 |
| DE | 102012110387 | A1 | 4/2014 |
| EP | 2117780 | B1 | 9/2011 |
| EP | 3181027 | A1 | 6/2017 |
| KR | 20130027627 | A | 3/2013 |
| RU | 2578999 | C2 | 3/2016 |

(Continued)

OTHER PUBLICATIONS

Office action dated Dec. 11, 2018 from the Russia counterpart application 2018128014/12.

(Continued)

*Primary Examiner* — Levon J Shahinian
(74) *Attorney, Agent, or Firm* — WPAT, P.C., Intellectual Property Attorneys; Anthony King

(57) ABSTRACT

The present invention discloses a robot that moves on a surface. The robot includes a casing, a moving unit coupled to the casing, and a suction disk coupled to the casing. The casing, the suction disk and the surface are configured to form an airtight space. The robot further includes an air extraction module and a spray module. The air extraction module is disposed in the casing and is in communication with the airtight space, and the air extraction module is configured to generate a negative pressure in the airtight space. The spray module is coupled to the casing and configured to spray a liquid onto the surface.

20 Claims, 12 Drawing Sheets

(56) References Cited

FOREIGN PATENT DOCUMENTS

| | | | |
|---|---|---|---|
| RU | 2016119622 | A | 11/2017 |
| TW | 200833286 | A | 8/2008 |
| TW | I580387 | B | 5/2017 |

OTHER PUBLICATIONS

English translation of the office action dated Dec. 11, 2018 from the Russia counterpart application 2018128014/12.
Summary and Search report of the office action dated Dec. 11, 2018 from the Russia counterpart application 2018128014/12.
English translation of TWI580387.
Office Action and Search Report dated Apr. 29, 2019 issued by Taiwan Intellectual Property Office for counterpart application 107118300.
English Abstract Translation for Office Action issued by Taiwan Intellectual Property Office.
Search Report dated Mar. 25, 2019 issued by the European Patent Office for counterpart application 18187447.0.
European Patent 2117780 is a counterpart application and serves as a translation to Foreign Patent TW200833286.

* cited by examiner

SPRAY MODULE AND ROBOT FOR USE THEREWITH

PRIORITY CLAIM AND CROSS-REFERENCE

This application claims priority to Chinese patent application Serial No. 201810530376.1 filed May 29, 2018, the disclosure of which is hereby incorporated by reference in its entirety.

FIELD OF THE INVENTION

The invention relates in general to a robot and an associated cleaning device.

BACKGROUND OF THE INVENTION

Household windows are conventionally cleaned manually, and sometimes window cleaning is performed by opening or removing the windows. For cleaning exterior surfaces of windows of tall buildings, a suspension rack provided by a cleaning service provider is suspended outside the building, the suspension rack is controlled to move up or down by a motor, and the exteriors of the windows are cleaned using brushes or water jet streams. However, the suspension rack can easily be tipped off balance, and is susceptible to being swung about by high winds, and thus can pose safety risks to cleaning service personnel. In addition, accidents, such as the cleaning service personnel slipping or cleaning equipment falling onto passersby below, may result from cleaning the windows with excessive water pressure, so that only low-pressure water streams are allowed, preventing the windows from being thoroughly cleaned. Thus, cleaning robots have been proposed to address the issues arising from cleaning windows manually.

During operation of a cleaning robot of the prior art, when the robot encounters an obstacle attached to a window, the robot will be tilted or entirely lifted from the window surface, causing air leakage of a suction disk and the failure of the robot to remain attached to the window surface. Further, given unsuitable distribution of the force between the moving wheels or a track belt and a suction disk, the robot is prone to losing traction and mobility, or unable to apply a wiping force sufficient to perform effective window cleaning.

A conventional cleaning robot cleans windows using a brush or cloth that is primarily suited for cleaning mild dirt and dust. If the window is stained or soiled with grime that cannot be easily removed, the wiping operation provided by such cleaning robot is unable to clean the window effectively. Therefore, there is a need for an improved solution to existing cleaning robots for enhancing the cleaning performance and efficiency.

SUMMARY OF THE INVENTION

The present invention provides a cleaning robot for improving the cleaning effectiveness of existing cleaning devices.

A robot is provided according to an embodiment of the present invention. The robot is operable to move on a surface, and includes: a casing; a moving unit, coupled to the casing; a suction disk, coupled on the casing, wherein the casing, the suction disk and the surface are configured to form an airtight space; an air extraction module, disposed within the casing and in communication with the airtight space, configured to generate a negative pressure in the airtight space; and a spray module, coupled to the casing, configured to spray a liquid onto the surface.

According to an embodiment of the present invention, a first region is defined by a border of the suction disk, a second region is defined by an area wherein the suction disk and the casing are in contact, and a remaining region is defined as an area inside the first region and outside the second region. Amounts of the negative pressure applied to the moving unit and the suction disk are determined by an area of the second region and an area of the remaining region, respectively.

According to an embodiment of the present invention, the spray module includes a water tank configured to store a liquid, and a water outlet configured to spray the liquid. The spray module further includes a water drawing unit configured to generate a driving force to discharge the liquid through the water outlet.

According to an embodiment of the present invention, the water drawing unit includes an ultrasonic vibration element.

According to an embodiment of the present invention, the ultrasonic vibration element includes a substrate and a vibration plate coupled to the substrate, the water outlet is disposed on the substrate, and the vibration plate surrounds the water outlet.

According to an embodiment of the present invention, the vibration plate is made of a piezoelectric material.

According to an embodiment of the present invention, the water drawing unit includes a pump, and the water output includes a nozzle.

According to an embodiment of the present invention, the water outlet includes an array of water outlet units.

According to an embodiment of the present invention, the spray module further includes a water inlet disposed on the water tank, and a lid for covering the water inlet, wherein the lid includes a recess and a slit on the recess.

According to an embodiment of the present invention, the recess is on an outer side of the lid.

BRIEF DESCRIPTION OF THE DRAWINGS

FIGS. 2A, 2B and 20 are cross-sectional views of the cleaning device in FIG. 1 along section lines AA, BB and CC, respectively.

FIG. 5 is a system functional block diagram of a cleaning device according to an embodiment of the present invention; an.

DETAILED DESCRIPTION OF THE EMBODIMENTS

Although the present disclosure refers to specific embodiments of the present invention and describes the present invention, the details of the description and illustration are not to be construed as limitations to the present invention. A person skilled in the art can understand that, without departing from the true spirit and scope of the present invention as defined by the appended claims, various modifications and equivalent substitutions can be made.

The present invention relates to a robot, which may be a toy, a remote control toy car, a cleaning device or a window cleaner. The robot can be attached to an inclined surface or a vertical surface, and is capable of moving freely on the inclined surface or the vertical surface without falling off due to the force of gravity. In some embodiments, the robot features a cleaning function that serves to clean the contact surface during the movement and thus achieves the purpose of cleaning the surface by moving back and forth on the surface. A cleaning device or a window cleaning device is used as an example for illustration only below, and it should be noted that the present invention is not limited to the cleaning device or the window cleaning device.

Figure 1:
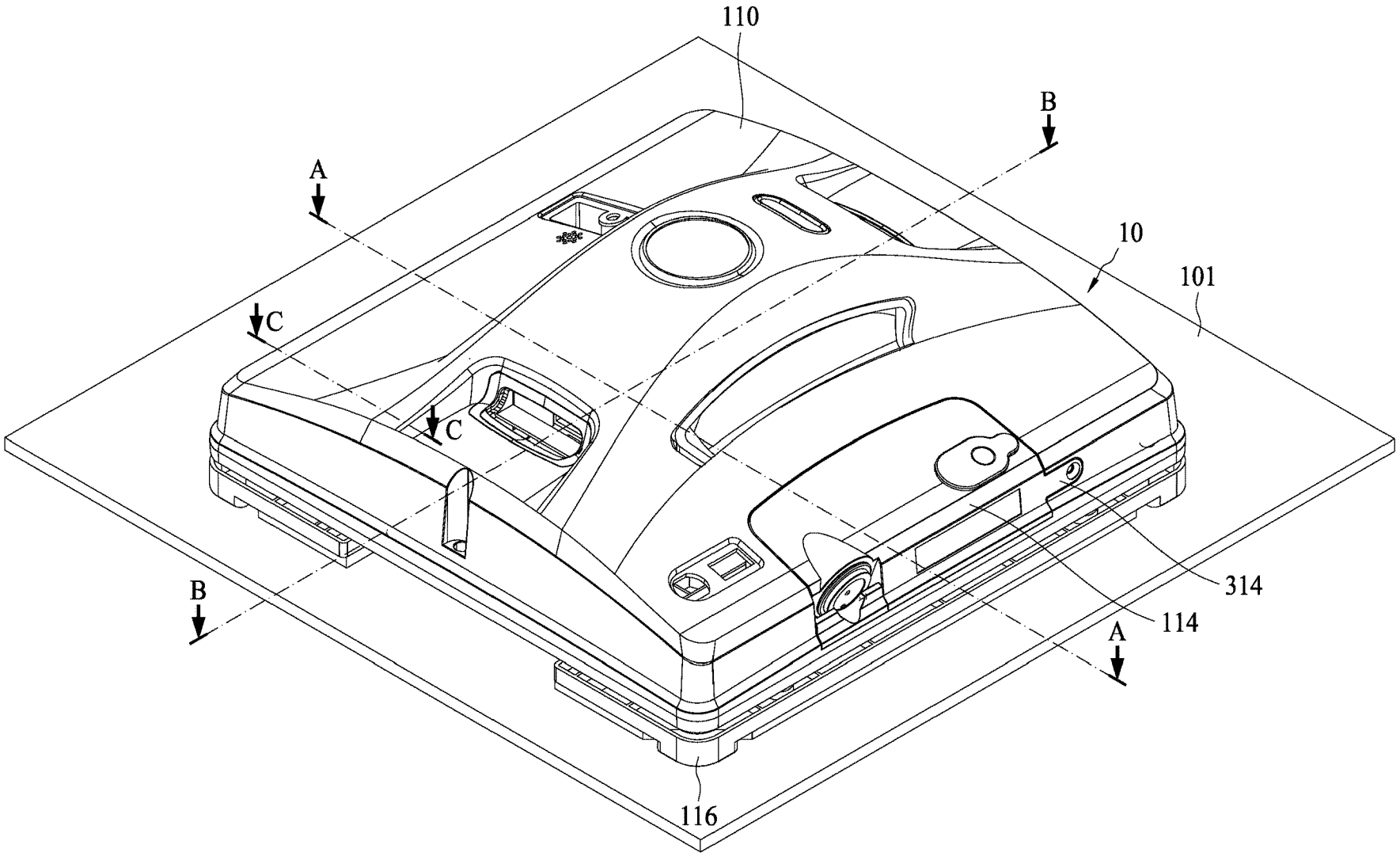
FIG. 1 is a perspective view of a cleaning device according to an embodiment of the present invention.
Figure 2A:
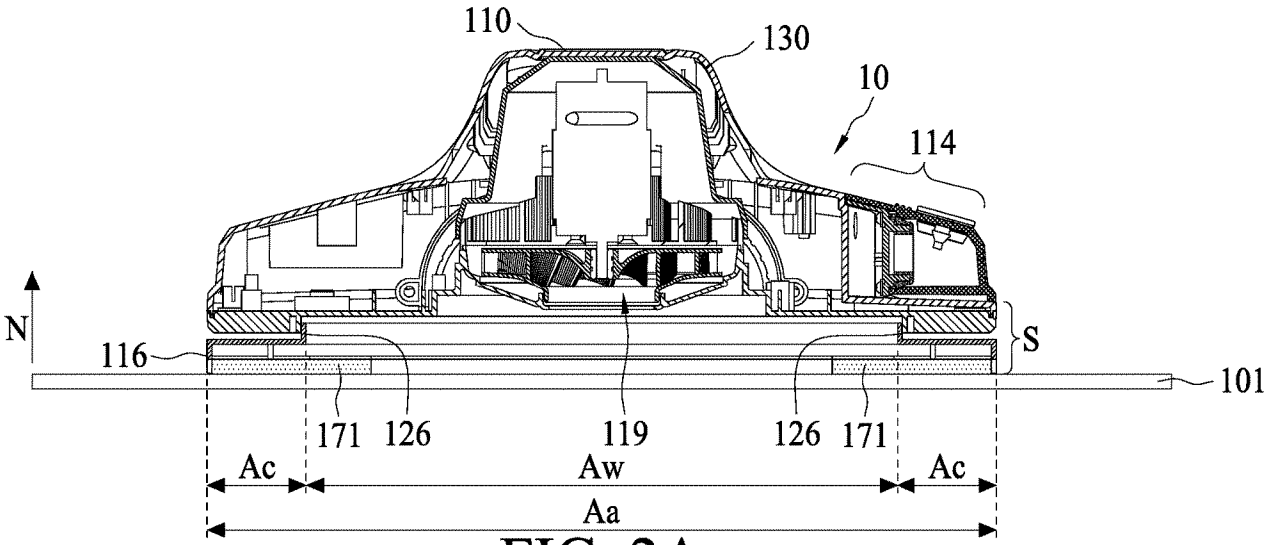
Figure 2B:
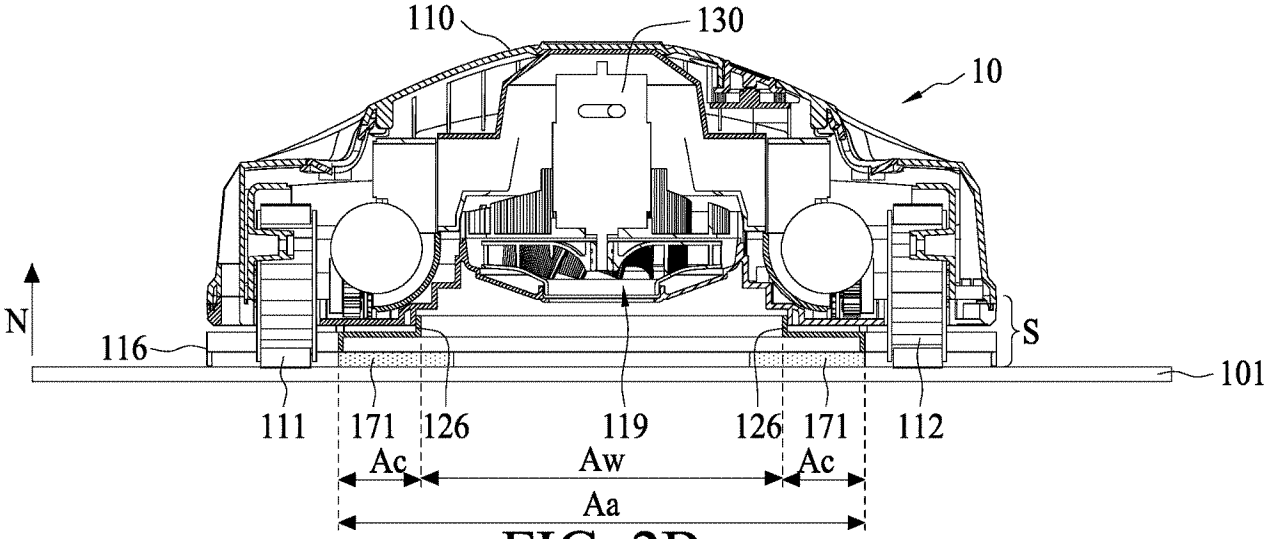

FIG. 1 is a perspective view of a cleaning device 10 according to an embodiment of the present invention. As shown in FIG. 1, the cleaning device 10 is operable to be attached to a flat object 101 and to move on the flat object 101 to clean dust or stains on a surface of the flat object 101. The flat object 101 may be a vertical window. The cleaning device 10 includes a casing 110, a spray module 114 and a suction disk 116. Referring to FIGS. 2A and 2B, the cleaning device 10 further includes moving units 111 and 112 for moving the cleaning device 10. The moving units 111 and 112 may be units, such as pulleys and rollers capable of generating movement, which drive the cleaning device 10 to move forward, move back or make turns on the surface of the flat object 101. In the depicted embodiment, the moving units 111 and 112 comprise pulleys, and include a track belt and two drive wheels for driving the track belt. In an embodiment, lower portions of the moving units 111 and 112 that contact the flat object 101 are coplanar with the suction disk 116.

Referring to FIG. 1, the casing 110 of the cleaning device 10 has an accommodation space, in which the spray module 114 is included. Further, the accommodation space is on one side of the cleaning device 10, and therefore the spray module 114 is provided on that side of the cleaning device 10, and facilitates the spraying of cleaning liquid onto the surface of the flat object 101. The spray module 114 is detachable so that a user can clean the spray module 114 or remove the spray module 114 for replenishing the cleaning liquid. In an embodiment, the cleaning liquid includes clean water or detergent. As shown in FIG. 1, the spray module 114 is embedded in the accommodation space of the casing 110, and includes a fastening member 314 fastened to the casing 110 and attached to the cleaning device 10. In an embodiment, the spray module 114 is not embedded in the cleaning device 10, but is attached or adhered to the casing 110 of the cleaning device 10. According to such configuration, at least part of the area on one side of the casing 110 includes an element, such as a magnet or a metal, and the spray module 114 includes a similar element, such as a magnet or a metal. The spray module 114 is thereby attached to the side of the casing 110 through magnetic force. In another embodiment, other adhesive parts, such as a detachable tape or a hook-and-loop fastener, may also be used to couple the spray module 114 with the casing 110.

FIGS. 2A and 2B are cross-sectional views of the cleaning device 10 in FIG. 1 along cross-sectional lines AA and BB, respectively. Referring to FIGS. 2A and 2B, the cleaning device 10 includes an air extraction module 130 in the casing 110. A space between the casing 110 and the suction disk 116 is in communication with the air extraction module 130 through an air intake device 119, such that the air intake device 119 and the air extraction module 130 operate to draw air away from the space. In an embodiment, the air intake device 119 is formed by a vane wheel. In an embodiment, the air extraction module 130 includes a pump. In operation, the cleaning device 10 is disposed on the flat object 101. At such, the flat object 101, the casing 110 and the suction disk 116 jointly define an airtight space S and a negative pressure is formed in which air in the airtight space S is drawn away by the air extraction module 130, thus enabling the attachment of cleaning device 10 to an operation surface of the flat object 101.

Figure 2C:
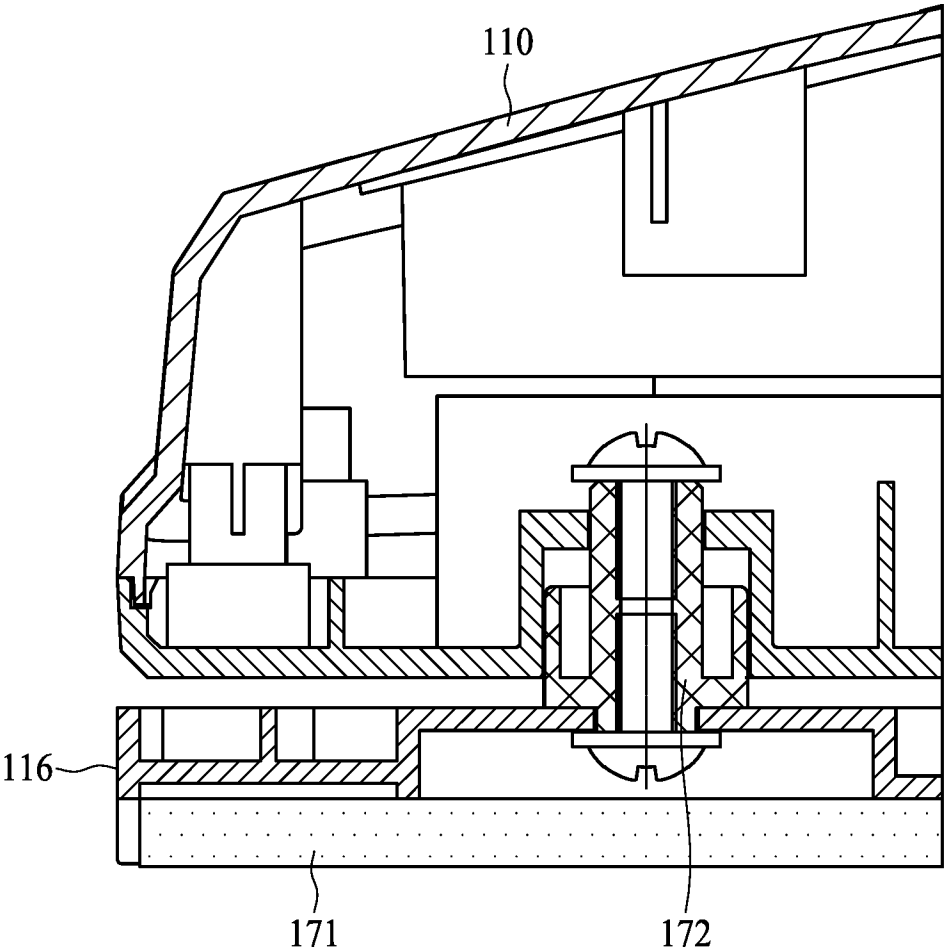
Figure 2D:
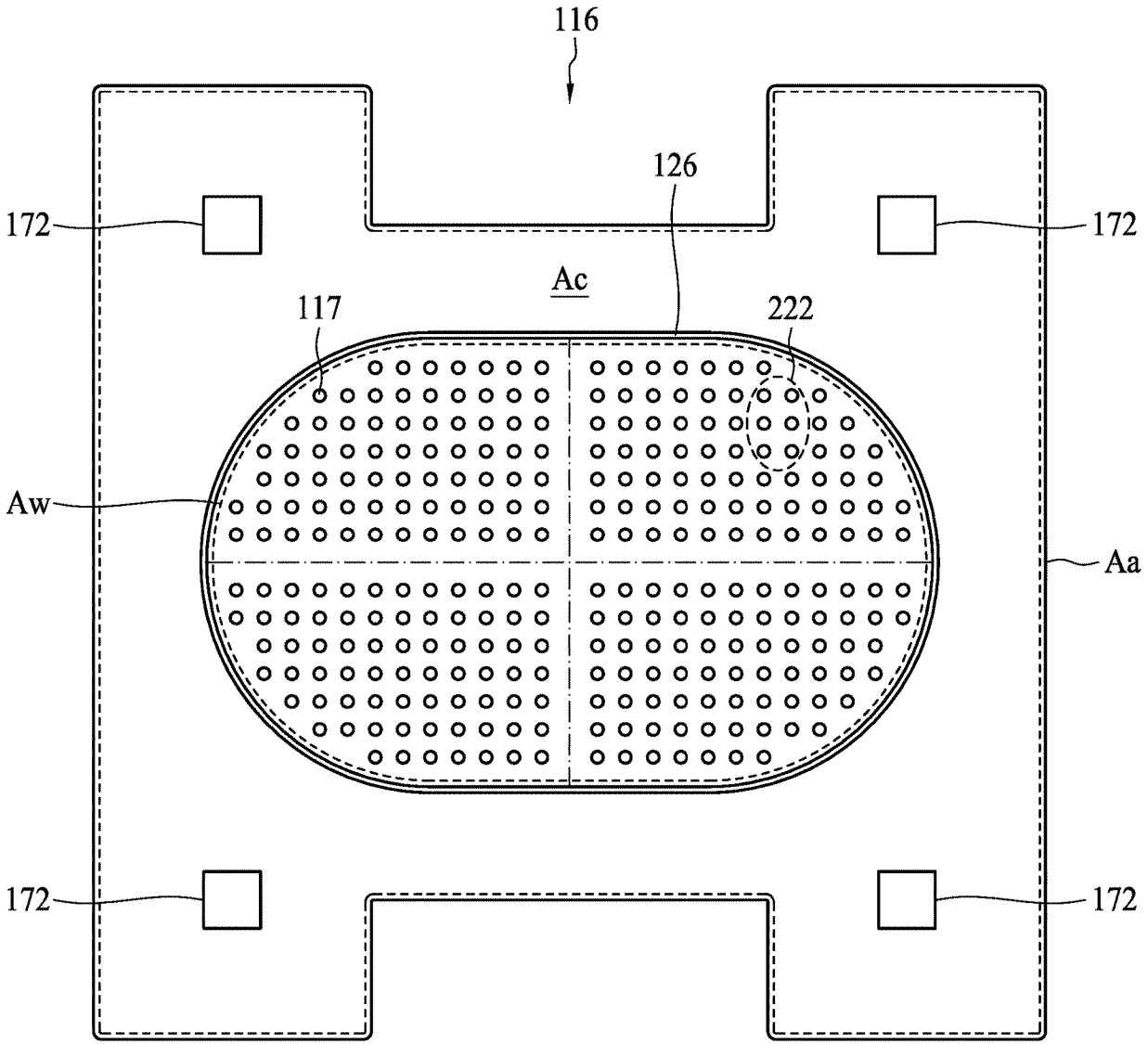
FIG. 2D is a bottom view of the cleaning device in FIG. 1.

FIG. 2C is a cross-sectional view of the cleaning device 10 in FIG. 1 along a cross-sectional line CC. FIG. 2D is a bottom view of the cleaning device 10 in FIG. 1. As shown in FIGS. 2C and 2D, the cleaning device 10 further includes multiple shafts 172, which are located around corners of the suction disk 116, fixed on the suction disk 116 and extending towards the casing 110. The casing 110 is movably connected to the suction disk 116 via the shafts 172. Referring to FIGS. 2A, 2B and 2C, the suction disk 116 can move relative to the casing 110 via the shafts 172. More specifically, the casing 110 is provided with multiple through holes (not shown) for the shafts 172 to pass through. The length of the shafts 172 is greater than that of the corresponding through holes such that the suction disk 116 is pivotally connected to the casing 110 via the shafts 172. As a result, the suction disk 116 is allowed to move along the longitudinal axis of the shafts 172. Thus, the suction disk 116 can move relative to the casing 110 via the shafts 172 and can be driven by the casing 110. In a preferred example, the longitudinal axis of the shafts 172 is substantially parallel to the direction of a normal line N perpendicular to the bottom surface of the suction disk 116, and thus the suction disk 116 moves along the normal line N. In an embodiment, the longitudinal axis of the shafts 172 is substantially parallel to a normal line perpendicular to the surface of the flat object 101, and thus the suction disk 116 moves along the normal line perpendicular to the surface of the flat object 101.

According to an embodiment of the present invention, the suction disk 116 is configured to move relative to the casing 110 and the moving units 111 and 112. Thus, when the moving units 111 and 112 encounter an obstacle and run over it, the suction disk 116 is able to move up and down in response to the change in the heights of the moving units 111 and 112, thereby keeping a close attachment to the flat object 101. Accordingly, the airtightness of the airtight space S is maintained and air leakage of the airtight space S is prevented. Further, when the suction disk 116 encounters an obstacle and runs over it, the casing 110 of the cleaning device 10 is also able to move up and down relative to the suction disk 116 via the shafts 172 so as not to tilt the suction disk 116. As a result, the airtightness in the airtight space S is maintained, and the suction disk 116 can maintain the attachment force to the flat object 101 through the negative pressure in the airtight space S.

Referring again to FIGS. 2A, 2B and 2D, in operation, the suction disk 116 is parallel to and faces the flat object 101. A border of the suction disk 116 defines a first region Aa. The suction disk 116 includes several vent holes 117 at a central part of the suction disk 116, and an abutting portion 126 around the vent holes protrudes towards the casing 110 and surrounds the zone where the vent holes 117 are located. This zone, defined as a second region Aw, is formed by an area of the suction disk 116 contacting the casing 110. When the air extraction module 130 extracts air, the suction disk 116 and the casing 110 jointly compose an encircling body above the airtight space S; the abutting portion 126 contacts the casing 110; the abutting portion 126, the casing 110 and the underlying flat object 101 form the airtight space S; and air is drawn out of the airtight space S through the vent holes 117. As shown in FIG. 2D, the area of the first region Aa is greater than the area of the second region Aw, and the area of the first region Aa minus the area of the second region Aw defines the area of a remaining region Ac. That is, the remaining region Ac comprises the area outside the second region Aw and inside the first region Aa, or the area surrounded by the border of the suction disk 116 minus the area surrounded by the abutting portion 126. The negative pressure in the airtight space S is substantially uniformly applied across the surface defining the airtight space 5, e.g., surfaces of the flat object 101, the suction disk 116 and the casing 110. Within the remaining region Ac, the atmospheric pressure is applied to the suction disk 116 through the negative pressure. Within the second region Aw, the atmospheric pressure is applied to the moving units 111 and 112 through the negative pressure. Therefore, the pressure or suction force of the negative pressure of the airtight space S is distributed among the moving units 111 and 112 and the suction disk 116 according to the proportions of the area of the second region Aw and the area of the remaining region Ac, respectively.

According to the design of the present embodiment, a first force applied to the moving units 111 and 112 is determined by the force of the negative pressure and the area of the second region Aw, and a second force applied to the suction disk 116 is determined by the force of the negative pressure and the area of the remaining region Ac. Therefore, through determining force-receiving areas of the second region Aw and the remaining region Ac, the first force applied to the moving units 111 and 112 and the second force applied to the suction disk 116 can be determined, and the proportions of the first force and the second force can be kept within a desired range. When the moving units 111 and 112 run over an obstacle, the second force applied to the suction disk 116 can still be maintained within a desired range to securely attach the suction disk 116 to the flat object 101, preventing air leakage of the airtight space S and therefore keeping the cleaning device 10 from slipping off.

Moving units and a suction disk of a cleaning robot in prior art are usually provided in an integral structure, in which the moving units are bounded in an airtight space formed by the suction disk and a flat object. Moreover, the force received by the moving units is obtained through the negative pressure in the airtight space of the suction disk. As a result, such design fails to distribute different proportions of the force of the negative pressure to the suction disk and the moving units. When the amount of the negative pressure cannot be managed properly, the force applied to the moving units or the suction disk may be an unsuitable amount of force, and thus unsuccessful movement or cleaning may result. For example, if the force caused by the negative pressure in the shared airtight space is unduly large, the force applied to the suction disk may be insufficient, and an insufficient wiping force may result. If the force applied to the suction disk is insufficient, the cleaning robot may not remain securely attached to a vertical surface and may fall off as a result. Further, if the cleaning robot runs over an obstacle, the robot may be prone to be lifted off the cleaning surface and become tilted, causing air leakage of the airtight space and the falling off of the robot. In another scenario, if the force generated by the negative pressure and applied to the moving units is unduly small, the force generated upon the suction disk will be relatively large. The moving units may slip and the cleaning robot may not move successfully. In an embodiment, when 80% of the force resulting from the negative pressure of the airtight space is applied to the suction disk, it is very likely for the moving units to slip such that the cleaning robot cannot move successfully.

Further, with a cleaning robot of prior art, the moving units of the cleaning robot, such as rollers or pulleys, are not flexible, and the cleaning robot's moving units and suction disk cannot move relative to each other. The cleaning robot depends upon the flexibility of the disk to closely attach to a flat object and block leakage of air in order to maintain airtightness of the airtight space. However, an issue of such configuration is that, when the moving units encounter an obstacle, the suction disk will be lifted along with the tilting of the moving units due to lack of flexibility of the moving units and insufficient vertical (up and down) space margins of the moving units. Air may flow into the airtight space and the robot may fail to remain attached to a surface.

Referring again to FIG. 2A, in an embodiment, the suction disk 116 further includes a cleaning cloth 171 attached to the bottom surface of the suction disk 116. In an embodiment, the cleaning cloth 171 is elastic, and may be made of a material such as plant fiber, animal fiber or artificial fiber. When a negative pressure is generated within the airtight space while the atmospheric pressure generates a force upon the cleaning device 10, the cleaning device 10 is tightly pressed against the flat object 101, and the airtightness of the airtight space S is maintained through the cleaning cloth 171.

Figure 3A:
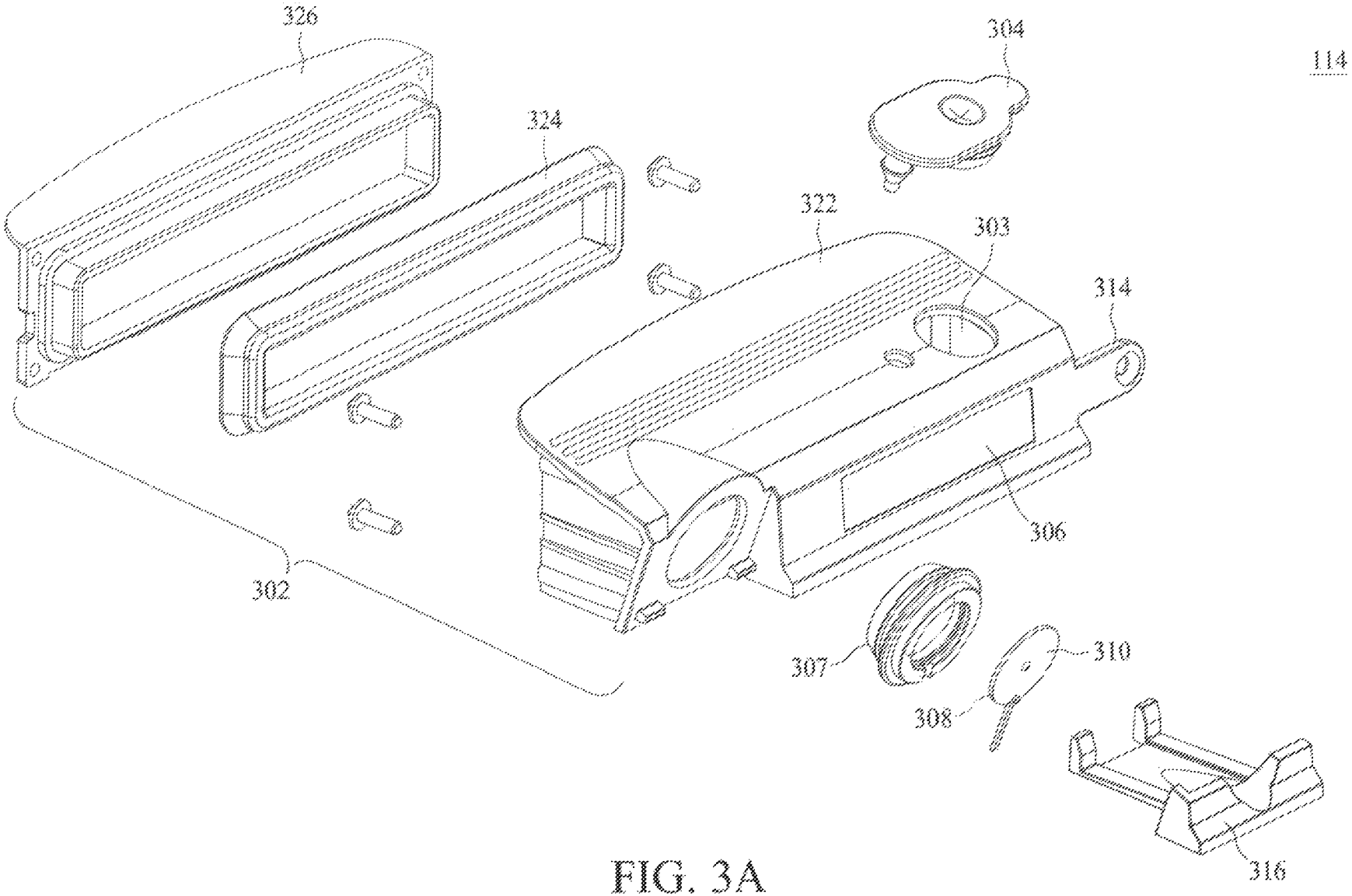
FIG. 3A is an exploded view of a spray module according to an embodiment of the present invention.

FIG. 3A shows an exploded view of the spray module 114 according to an embodiment of the present invention. The spray module 114 includes a water tank 302, a lid 304 and a water drawing unit 308. The water tank 302 is used for storing cleaning liquid and spraying the cleaning liquid onto the surface of the flat object 101 so as to perform cleaning in cooperation with the cleaning cloth 171 of the cleaning device 10. The water tank 302 includes a water inlet 303, a water level window 306, a waterproof component 307, a water outlet 310, a tank body 322, a waterproof component 324, a side cover 326 and the protection cover 326. The storage space of the water tank 302 is formed through watertight sealing of the tank body 322, the waterproof component 324 and the side cover 326, wherein the tank body 322 and the side cover 326 determine the capacity and the main structure of the storage space of the water tank 302. The waterproof component 324 is used for securing the water tightness of the tank body 322 and the side cover 326. In an embodiment, the tank body 322 and the side cover 326 are formed of rigid plastics, and the waterproof component 324 is formed of an elastic material. In an embodiment, the waterproof component 324 is formed of silicone rubber. The water inlet 303 is provided on a top surface of the tank body 322, and the water level window 306, the waterproof component 307 and the water drawing unit 308 are located on recesses on a side surface of the tank body 322. The waterproof component 307 fills the gap between the water drawing unit 308 and the tank body 322. In an embodiment, the waterproof component 307 surrounds the water drawing unit 308. In an embodiment, the waterproof component 307 is formed of silicone rubber. In an embodiment, the water outlet 310 is disposed on the water drawing unit 308. The protection cover 316 is used for fastening the water drawing unit 308 and the waterproof component 307 on the side surface of the tank body 322, in order to strengthen the water tightness of the water tank 302 around the waterproof component 307. In an embodiment, the fastening member 314 extends from the side surface of the tank body 322, and includes a fixing hole through which the tank body 322 is fastened and connected to the casing 110 of the cleaning device 10 (as shown in FIG. 1) using a fixing component (e.g., a screw).

The lid 304 is used for covering the water inlet 303, and the cleaning liquid is fed into the water tank 302 through the water inlet 303 when the lid 304 is opened. During normal operation of the cleaning device 10, the lid 304 can prevent the cleaning liquid from leaking out of the water inlet 303. In an embodiment, the water level window 306 is transparent or semi-transparent so as to allow a user to observe the level of water remaining in the water tank 302 and determine whether to refill or stop filling the cleaning liquid. In an embodiment, the water level window 306 is formed of resin or glass.

Figure 3B:
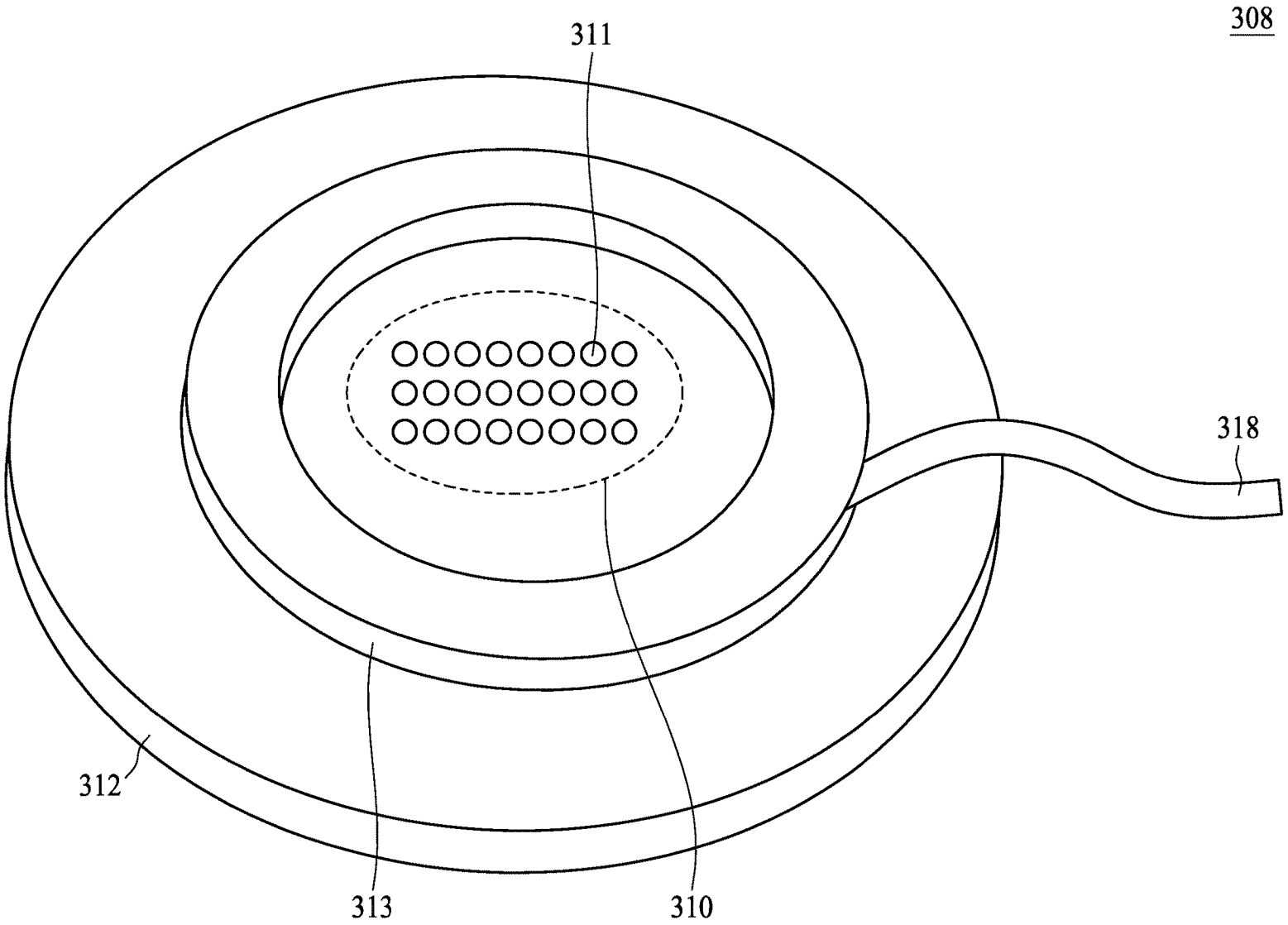
FIG. 3B is a schematic diagram of a water drawing unit according to an embodiment of the present invention.

The water drawing unit 308 discharges the cleaning liquid out of the water tank 302 through the water outlet 310 for spraying. In an embodiment, the water drawing unit 308 is a vibration element which discharges the cleaning liquid out of the water tank 302 through the water outlet 310 by a driving force of the vibration thereof. In an embodiment, the water drawing unit 308 is formed of an ultrasonic vibration element. FIG. 3B is a schematic diagram of the water drawing unit 308. The water drawing unit 308 may be an ultrasonic element including a substrate 312 and a vibration plate 313 with the vibration plate 313 coupled to the substrate 312. In an embodiment, the substrate 312 is formed of stainless steel. The vibration plate 313 is electrically connected to a power supply (not shown) via a conductive line 318 and is configured to convert electric energy into mechanical energy. In an embodiment, the vibration plate 313 is made of a piezoelectric material and has a thickness between 0.05 cm and 0.2 cm. In an embodiment, the water outlet 310 is manufactured using laser drilling or etching. As shown in FIG. 3B, the vibration plate 313 has a ring shape, and the water outlet 310 penetrates the substrate 312 and is located within a region surrounded by the vibration plate 313. In an embodiment, water outlet units 311 of the water outlet 310 have an aperture between about 0.005 and 0.1 cm. During operation of the ultrasonic vibration element 308, the vibration plate 313 is configured to vibrate back and forth when it is powered on, and a movement direction of the vibration plate 313 is perpendicular to the plane of the vibration plate 313. Referring to FIG. 1, FIG. 3A and FIG. 3B, when the water tank 302 is filled with the cleaning liquid, due to the relatively small aperture of the water outlet units 311, water will not leak out even when no other plugs or covers are present to block the water outlet units 311. Further, a compression force resulting from a vibration force is generated by the vibration plate 311, and the vibration plate 311 moves along with the substrate 312 towards the water tank. Accordingly, the cleaning liquid is discharged through the water outlet 310 and is sprayed outwardly. In an embodiment, the ultrasonic vibration element 308 communicates a vibration wave, through the vibration plate 313, with a frequency of at least 5 KHz. In an embodiment, the ultrasonic waves communicated by the ultrasonic vibration element 308 may span across multiple frequencies, e.g., ultrasonic waves of multiple frequencies. By driving water using an extremely thin ultrasonic plate 313, the ultrasonic vibration element 308 can provide a spray distance (e.g., at least 3 cm) as needed, while still being of a relatively compact size, and is thus particularly suitable for a spray module of a cleaning robot.

In the embodiment in FIG. 3B, the water outlet 310 includes multiple water outlet units 311, each of the water outlet units 311 having a circular shape. In other embodiments, each water outlet unit 311 may have a semicircular, rectangular, or other polygonal shape. The water outlet units 311 are arranged in a rectangular array for spraying the cleaning liquid. The array shape of the water outlet 310 shown in FIG. 3B is for illustration only, and other forms of arrays may also be adopted, e.g., circular, arched, polygonal, annular, or multi-row arrays. Parameters of the water outlet design in an array include at least the amount, aperture size, aperture positions and spacings of the water outlet units 311. The spray profile formed on the flat object 101 is generally closely related to the structure and shape of the water outlet 310. Replacing a single water outlet having a large aperture with the water outlet 310 having the structure of multiple water outlet units 311 can increase the throughput of water while also preventing water leakage while the spray module is not in operation. Moreover, an array-shaped water outlet further provides the advantages that the array configuration and the aperture and shape of the water outlet units can be determined according to the desired spray profile and the spray amount of the spray module 114. Thus, the range of spraying can be made broader with greater spraying precision and the sprayed liquid can be distributed more uniformly, thus reducing the liquid consumption while achieving a better spraying performance.

Figure 3C:
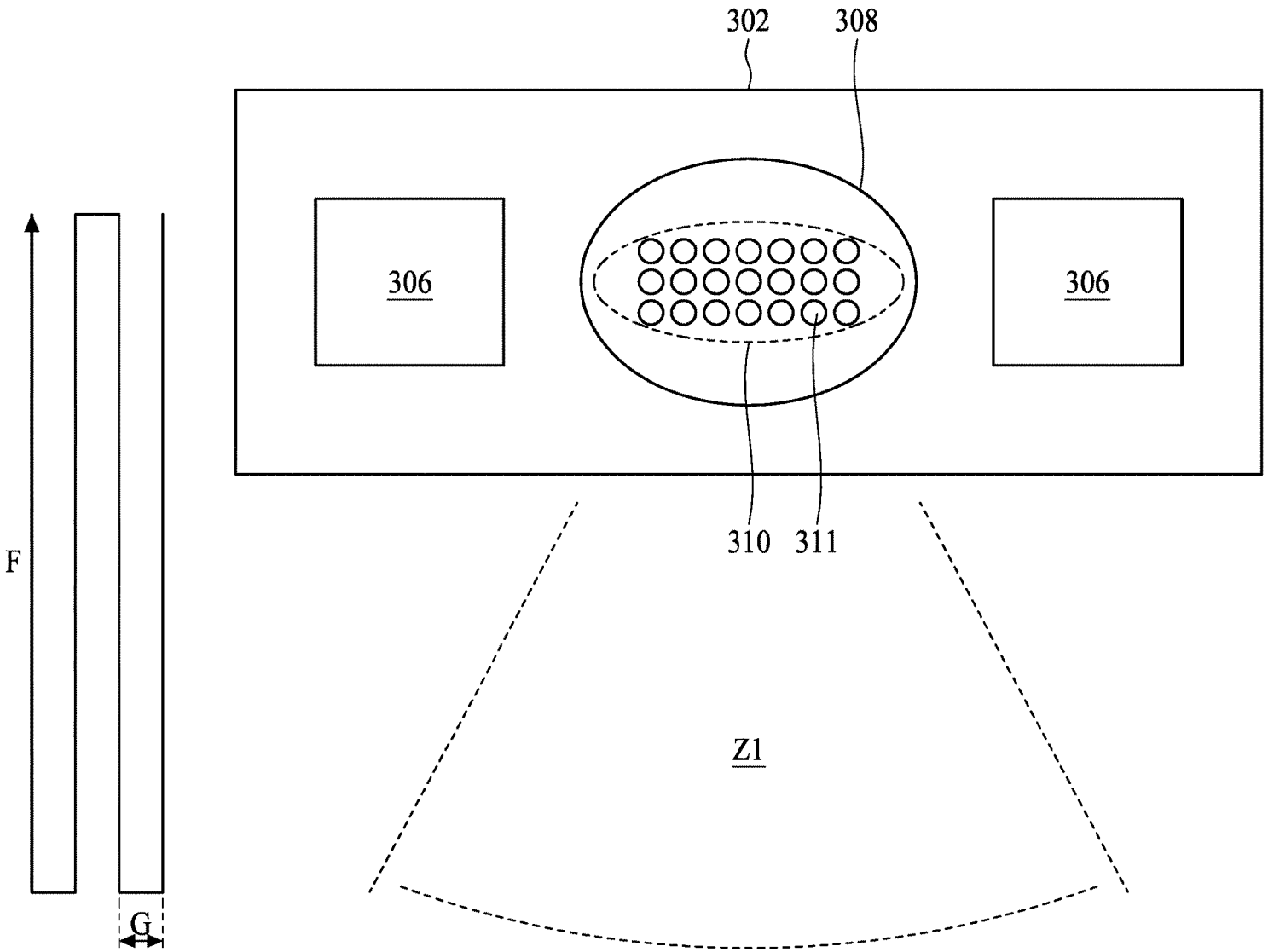
FIG. 3C is a schematic diagram of a spray module according to an embodiment of the present invention.
Figure 3D:
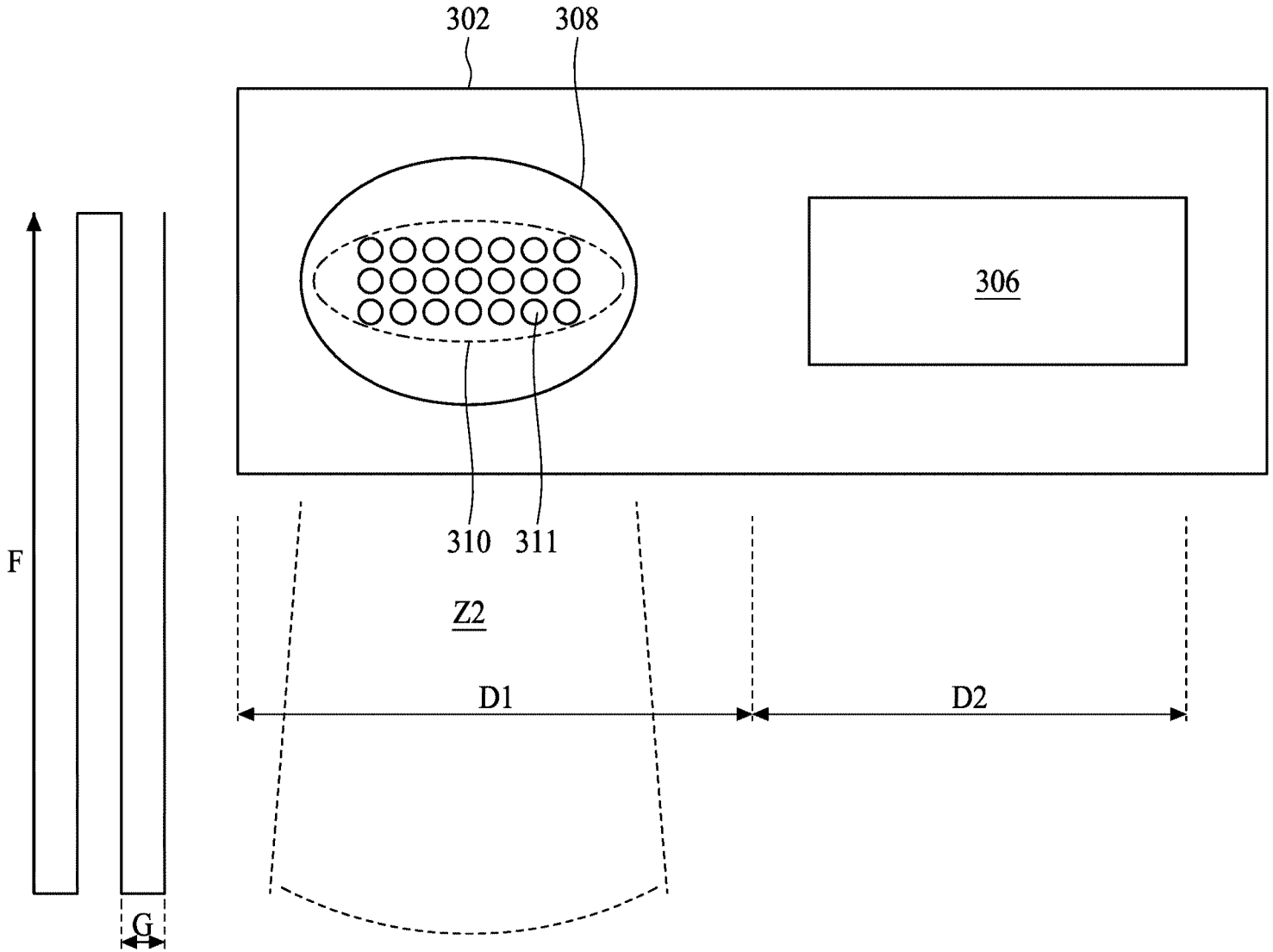
FIG. 3D is a schematic diagram of a spray module according to another embodiment of the present invention.

FIG. 3C is a schematic diagram of the spray module 114 according to an embodiment of the present invention. The water tank 302 includes two water level windows 306 on a side surface, and the water drawing unit 308 is disposed near the center of the side surface of the water tank 302, i.e., between the two water level windows 308. In an embodiment, the cleaning device 10 is configured to operate in a wet-cleaning mode, and the water outlet 310 is disposed near the center of the side surface of the cleaning device 10. When the cleaning device 10 moves, the cleaning device 10 may move along a direction F (e.g., along a zigzag route, wherein a gap G is formed between adjacent parallel paths), the area in front of the water tank 302 is substantially watered and wetted, and the cleaning device 10 performs a wiping operation on the wetted flat object 101 as the cleaning device 10 passes. The wet-cleaning mode is more effective in removing oily spots or adhered stains and provides better cleaning performance compared to a dry-cleaning mode. In the wet-cleaning mode, most regions of the cleaning cloth 171 are wetted by the cleaning liquid on the flat object 101 during the wiping process.

In another embodiment, the cleaning device 10 is configured to operate in a wet and dry-cleaning mode, which provides improved cleaning performance over that of only a wet-cleaning mode or only a dry-cleaning mode. Initially, as shown in FIG. 30, a side of the water tank 302 of the spray module 114 includes one single water level window 306 and the water drawing unit 308 in which the water drawing unit 308 is disposed near a corner of the side of the water tank, i.e., being apart from the central line of the water tank 302. In the wet and dry-cleaning mode, the area of the flat object 101 to be cleaned by the cleaning device 10 is partitioned into different sections, e.g., at least a first section 01 and a second section D2. The first section 01 may be regarded as a sprayed section, and the second section D2 may be regarded as a dry section. Under such configuration, the water outlet 310 of the spray module 114 is disposed in a region facing the sprayed section D1. As the cleaning device 10 progresses along the direction F (e.g., a zigzag route), the gap G between adjacent parallel paths can be reduced such that the wiping ranges of the adjacent paths visited by the cleaning device 10 partially overlap and the same section will be wiped at least twice by the cleaning device 10. Further, the array of the water outlet 310 is disposed closer to a corner, and the sprayed liquid is more easily kept within the sprayed section D1, causing the sprayed section D1 to be wetted while the dry section D2 is kept dry. Thus, when the cleaning device 10 cleans the sprayed section D1 for the first time, the cleaning device 10 operates in the wet-cleaning mode, and the cleaning liquid on the sprayed section D1 is substantially removed by the corresponding wetted region on the cleaning cloth 171. At such moment, the dry region of the cleaning cloth 171 corresponding to the dry section D2 has substantially not been wetted. Next, when the cleaning device 10 passes over the sprayed section D1 for the second time, the dry region of the cleaning cloth 171 performs a dry-mode wiping. With the at least two rounds of wiping processes, the wetted region of the cleaning cloth 171 in a wetted status can clean and remove stains, and the passing of the dry region of the cleaning cloth 171 in a dry status can completely remove water stains and remaining spots, thus achieving better cleaning performance.

Figure 3F:
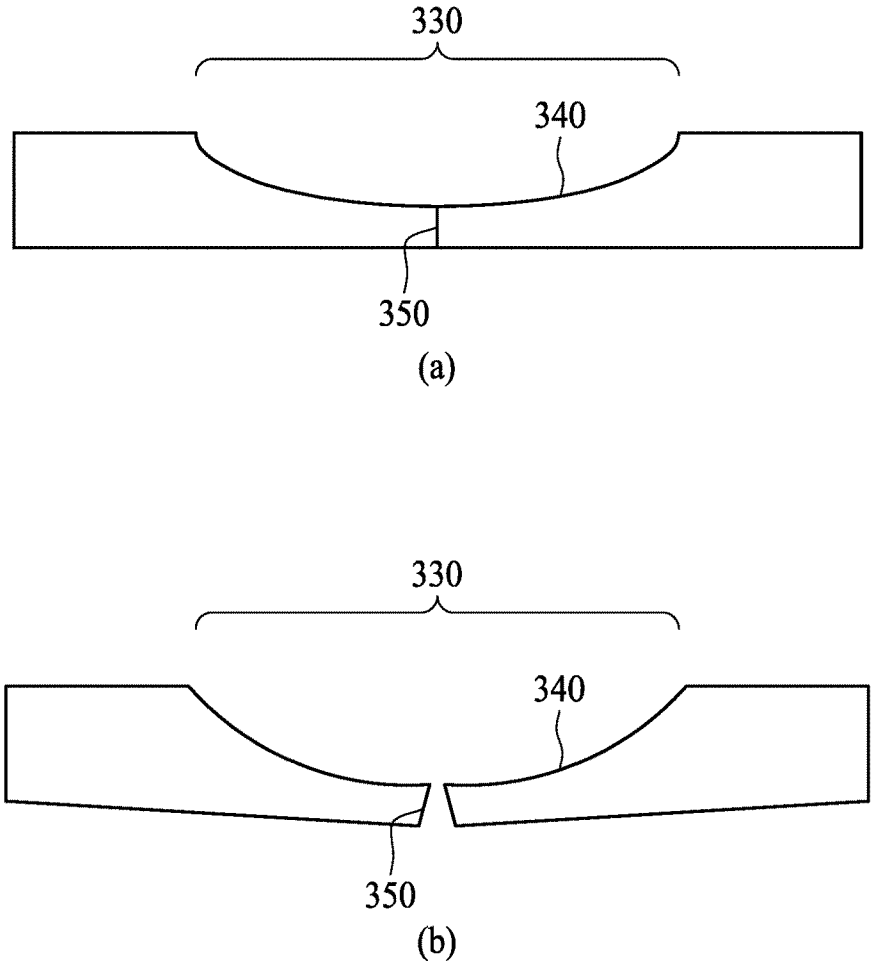
FIGS. 3E and 3F are schematic diagrams of a lid according to an embodiment of the present invention.
Figure 3E:
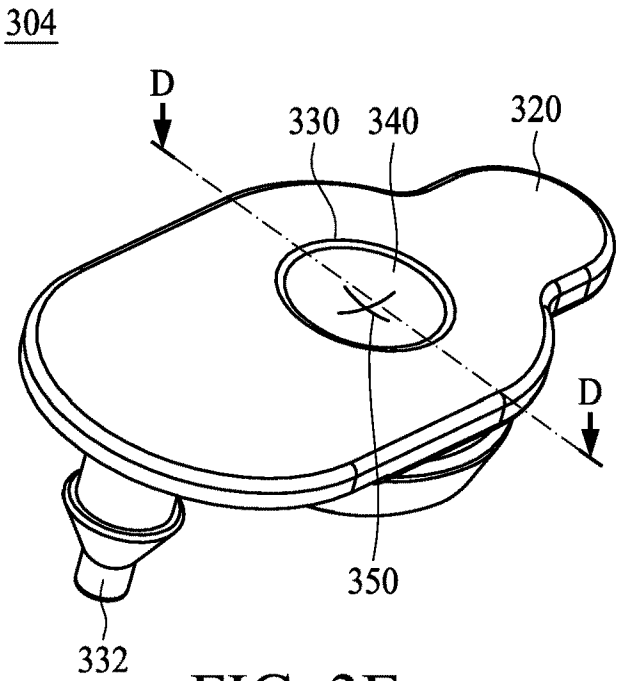

FIG. 3E is a schematic diagram of the lid 304 according to an embodiment of the present invention. The lid 304 includes a lid body 320 and a plug 332. The lid body 320 has a substantial plate shape and is configured to seal the water inlet 303. The plug 332 is connected to the lid body 320 and is configured to fasten the lid body 320 to the water tank 302. In an embodiment, the lid body 320 and the plug 332 are made of an elastic material (e.g., silicone) by which the lid 304 provides a better water tightness and the lid 304 can be opened through bending the lid body 320. Thus, when the lid 304 is not opened, the cleaning liquid will not leak out of the water inlet 303. The lid body 320 further includes a recess 330 at a top surface on an outer side of the lid 304 at a location aligned with the water inlet 303. The recess 330 has a recessed surface 340 and a split hole 350, wherein the split hole 350 is located in a central region of the recessed surface 340. In an embodiment, the split hole 350 may have a slit or cross shape, or other shapes. The split hole 350 penetrates the lid body 320 and includes a small gap that prevents the cleaning liquid from passing through, and thus the cleaning liquid will not leak from the split hole 350.

FIG. 3F provides cross-sectional views of the lid 304 along the cross-sectional line DD according to an embodiment of the present invention. As shown in FIG. 3F, the pressure in the water tank 302 is balanced using the split hole 350 of the lid 304. FIG. 3F(a) shows the shape of the recess 330 when the water tank 302 is almost at a full water level. In such situation, the inside of the water tank 302 is almost filled with the cleaning liquid, and thus the water outlet 310 is able to dispense water through the water drawing unit 308. Due to the balanced pressures on the inside and outside of the water tank 302, the split hole 350 is configured at a closed status. FIG. 3F(b) shows the shape of the recess 330 when the water level in the water tank 302 decreases. When the cleaning device 10 continues to operate and sprays the cleaning liquid, the water level in the water tank 302 decreases. However, because the lid 304 seals the water inlet 303, the newly-created accommodation space in the water tank 302 is in a quasi-vacuum status, and a negative pressure is thus generated. If the negative pressure is not balanced, the water drawing unit 308 will not be able to successfully discharge the remaining cleaning liquid out of the water outlet 310. Because the recess 330 has less thickness compared to other portions of the lid body 320, and the split hole 350 is located at the center with the least thickness of the recessed surface 340, when the negative pressure is generated in the water tank 302, the atmospheric pressure naturally presses the recess 330 downwardly towards the water tank 302, and the water tank 304 is opened at the split hole 350. At such, air is directed into the water tank 302, and the pressures inside and outside the water tank 302 regain balance. In the meantime, the elasticity of the recess 330 causes the recess 330 to bend upwards, the gap of the split hole 350 is filled and the split hole 350 is restored to its original closed shape. Therefore, according to such design, the water drawing unit 308 does not consume a large amount of operating power, and a desired output power, that provides a smooth water discharging process can be obtained.

Figure 4:
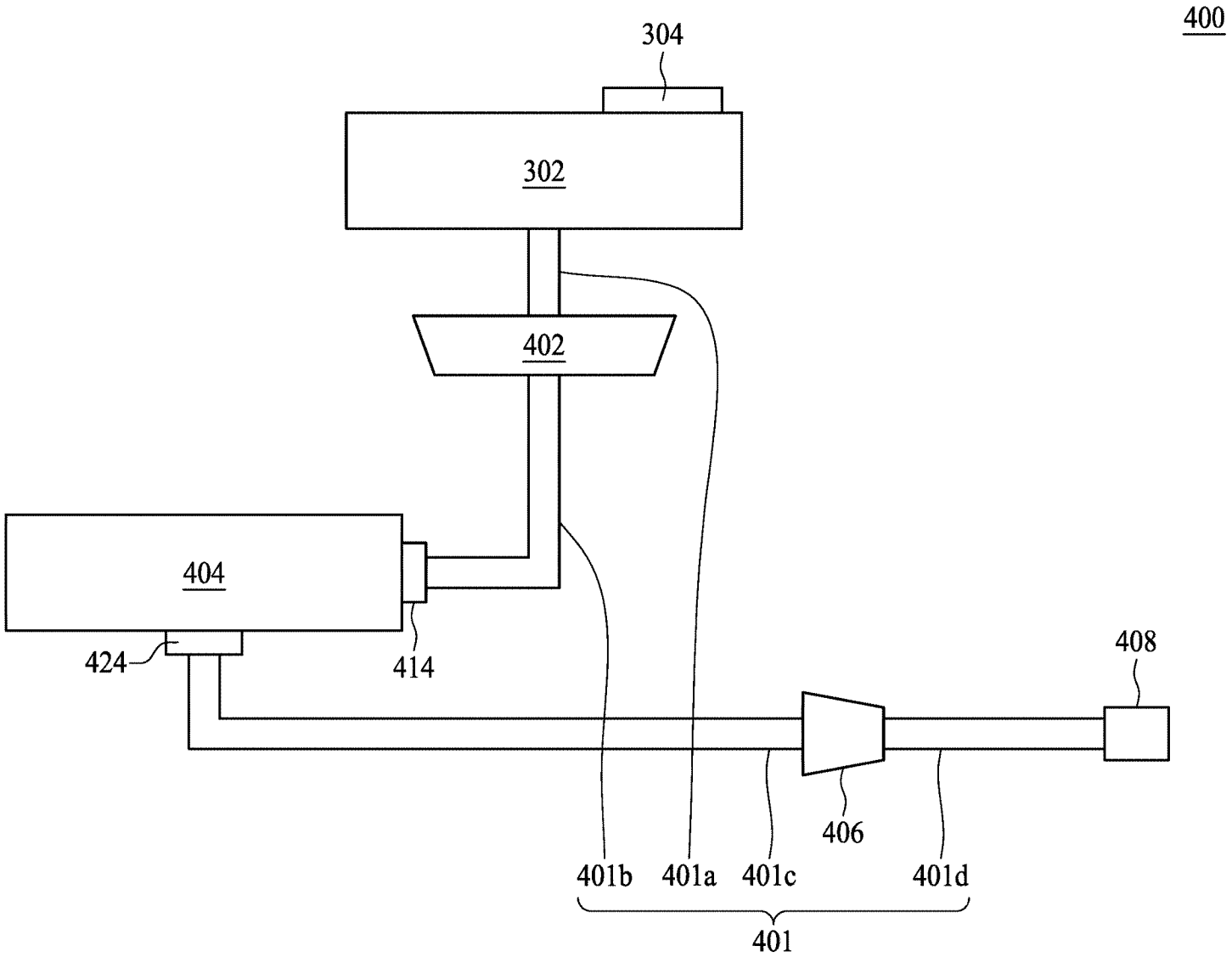
FIG. 4 is a schematic diagram of a spray module according to an embodiment of the present invention.

FIG. 4 is a schematic diagram of a spray module 400 according to an embodiment of the present invention. The spray module 400 includes a water tank 302, a filter 402, a water drawing unit 404 and a water outlet 408, all of which are connected through pipes 401 (including pipes 401*a* through 401*d*). In an embodiment, the filter 402 is used for filtering out solid impurities in the cleaning liquid so as to prevent malfunctioning of other components (e.g., the water drawing unit 404) due to the impurities. In an embodiment, the water drawing unit 404 is a pump and is used for receiving the cleaning liquid of the water tank 302 from an input 414, boosting the pressure of the cleaning liquid, and outputting the cleaning liquid to the water outlet 408 through an output 424 for spraying. The pump 404 may be disposed at other positions according to the structural requirements of the spray module 114 or the cleaning device 10, e.g., located in the water tank 302 or located outside the water tank 302, and the pump 404 transports the pressure-boosted cleaning liquid to the water outlet 408 through a pipe 411. In an embodiment, the water outlet 408 is a nozzle and may extend outwardly from the water tank 302 or the casing 110 of the cleaning device 10. In an embodiment, the spray module 400 further includes a backflow barrier 406 between the water drawing unit 308 and the nozzle 408, and the backflow barrier 406 is configured to prevent the cleaning liquid in the pipe 401*d* from leaking out of the nozzle 408. In an embodiment, the backflow barrier 406 includes a barrier piece and a spring piece (not shown). When the cleaning liquid flows from the water drawing unit 404 towards the nozzle 408, the barrier piece keeps open the channel of the backflow barrier. If the cleaning liquid flows from the nozzle 408 back to the water drawing unit 404, the reverse flowing force of the cleaning liquid in the pipe 401*d* moves the spring piece and causes the barrier piece to block the channel of the backflow barrier 406, thus preventing the cleaning liquid from flowing backwards. When the water drawing unit 404 is not in a water drawing operation, the spring piece of the backflow barrier 406 presses the barrier piece to block the cleaning liquid from flowing such that the cleaning liquid in the pipe 401*c* will not flow towards the pipe 401*d*, and at the same time the cleaning liquid in the pipe 401*d* will not leak out of the nozzle 408.

In an embodiment, the water outlet 408 of the spray module 400 may be placed on the side of the water tank 302 in a manner similar to that of the water outlet 310 in FIG. 3A. However, the nozzle 408 may also be provided at positions other than the side of the water tank 302. Referring to FIG. 2D, the suction disk 116 is provided along with the array of vent holes 107 in communication with the air extraction module 130, and thus the air in the airtight space S can be discharged through the vent holes 117 during air extraction. Further, through holes 222 are provided next to the vent holes 117 and the water outlet 408 faces the through holes 222, thus allowing the cleaning liquid to be sprayed downwardly towards the flat object 101. In an embodiment, the multiple through holes 222 connected to the water outlet 408 form an array of water outlets to generate a spray profile as desired. In an embodiment, even if the water tank 302 is still disposed on the side of the casing 110, the water outlet 408 is still able to be coupled to the water tank 302 through the pipe 401 and aligned downwardly with the through holes 222, achieving the purpose of downward spraying. In an embodiment, at least a portion (i.e., the through holes 222) of the spray module 400 is located within the airtight space S such that the spray module 400 can spray the cleaning liquid towards the surface of the flat object 101 that surrounds the airtight space S. Although the negative pressure is present in the airtight space S, such negative pressure is not strong enough to pull the cleaning liquid away from the flat object 101, and thus the spraying of cleaning liquid is still workable within the airtight space S along with the movement of the cleaning device 10 in which the liquid is to be sprayed to desired locations on the flat object 101.

Figure 5:
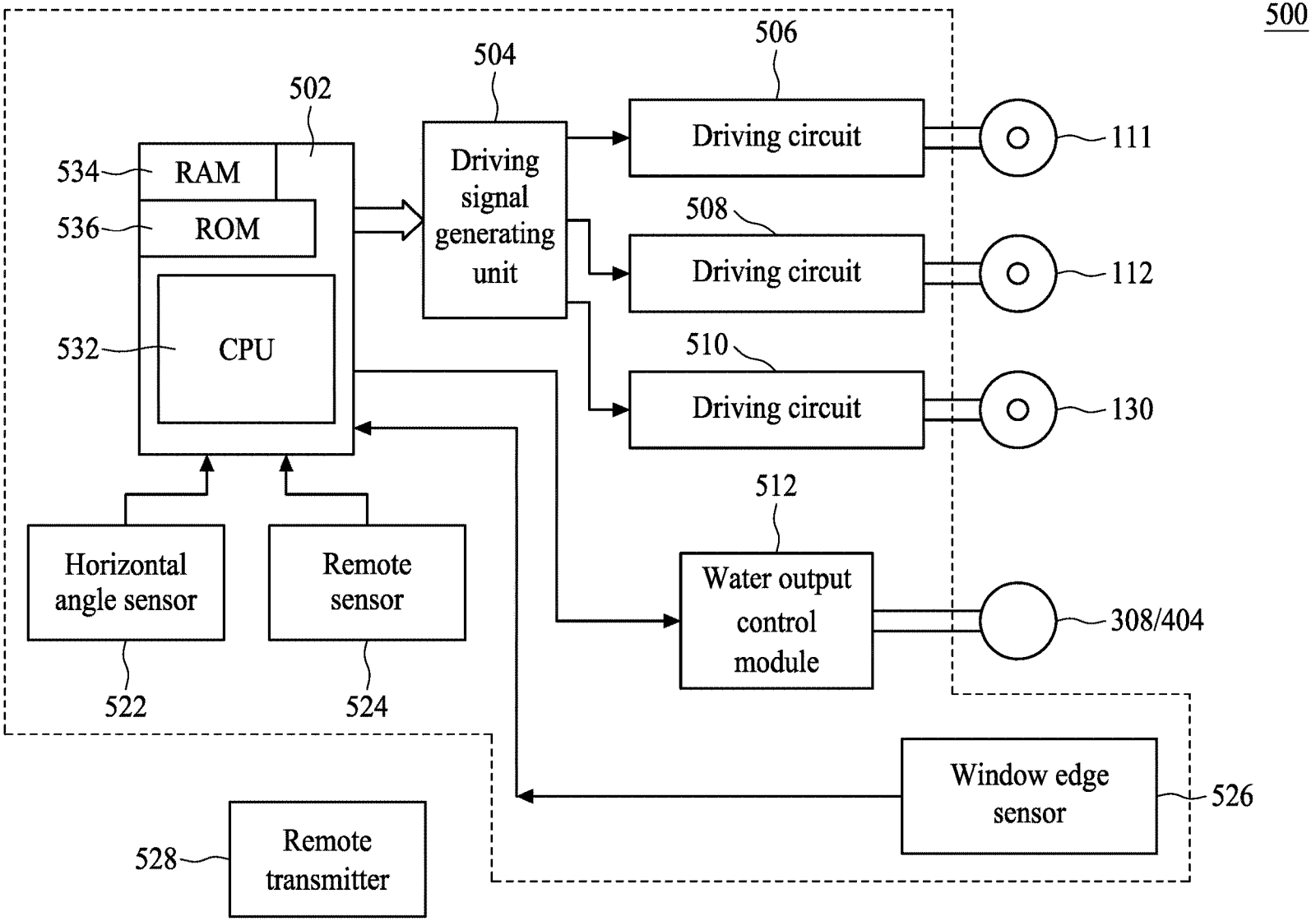

FIG. 5 is a system function block diagram of the cleaning device 10 according to an embodiment of the present invention. The cleaning device 10 includes a control system 502, a driving signal generating unit 504, driving circuits 506, 508 and 510, a water output control module 512, a horizontal angle sensor 522, a remote sensor 524 and a window edge sensor 526. The control system 502 includes a center processing unit (CPU) 532, a random access memory (RAM) 534 and a read-only memory (ROM) 536. The cleaning device 10 is configured to access a control process in the RAM 534 or the ROM 536 through the CPU 532 and perform operations, such as moving, sensing and clearing liquid spraying of the cleaning device 10. In an embodiment, the ROM 536 can be replaced by a flash memory. The CPU 532 is configured to generate a control signal to determine a control waveform that is to be generated by the driving signal generating unit 504. In an embodiment, the driving signal generating unit 504 is configured to generate a pulse width modulation (PWM) signal. By adjusting the width and the duty cycle of the PWM waveform, the operating frequency of the moving units 111 and 112 or the air extraction module 130 can be managed. The driving circuits 506, 508 and 510 are respectively connected to the moving unit 111, the moving unit 112 and the air extraction module 130, and the driving circuits 506, 508 and 510 are configured to drive the moving unit 111, the moving unit 112 and the air extraction module 130 according to the PWM signals generated by the driving signal generating unit 504.

The control system 502 is further connected to the water output control module 512 to control the operation of the water drawing unit 308 or 404. In an embodiment, the water output control module 512 receives movement parameters associated with the moving units 111 and 112 through the control system 502, e.g., information on the moving speed of the moving units 111 and 112 or information on whether the moving units 111 and 112 remain in place, so as to determine whether to increase or decrease the amount of the cleaning liquid or stop the spraying. In an embodiment, the water output control module 512 may be included in the CPU 532. In an embodiment, the water output control module 512 further includes a driving circuit, e.g., the driving circuit 506, 508 or 510, and is used for driving the water drawing module 308 or 404. In an embodiment, the water drawing module 308 or 404 may include a wireless receiver, and the water output control module 512 may transmit control signals by wireless transmission means to the water drawing unit 303 or 404 such that the driving circuit in the water drawing unit 308 or 404 can control the operation of the pump or the ultrasonic vibration element according to the wireless control signal. The wireless transmission means includes infrared transmission, ZigBee, Bluetooth, RFIO, Wi-Fi, FM or other appropriate specifications.

As described above, the water output control module 512 is configured to determine the water discharging mode of the spray module 114. In an embodiment, the water discharging mode may be a continual discharging mode or an intermittent discharging mode. When the spray module 114 operates in the intermittent discharging mode, the water output control module 512 may transmit a periodic signal, e.g., a PWM signal, to determine the proportion of the spray time. The duty cycle of the PWM signal may be used to determine the duty cycle of the water drawing unit 308 or 404 so as to control the water drawing unit 308 or 404 to generate a periodic driving force. In an embodiment, the water output control module 512 may use a pulse position modulation (PPM) signal to determine the time at which liquid is discharged in a constant period. In an embodiment, the water outlet control module 512 may use a pulse amplitude modulation (PAM) signal to change the output power of the water drawing unit 308 or 404 to further control the amount of water discharged. The abovementioned methods are for illustration only, and other modulation signals, e.g., digital modulation or frequency modulation signals, may also be used to generate the control signal of the water output control signal 512.

The horizontal angle sensor 522 is used for sensing a horizontal level of the cleaning device 10 and transmits the sensing value to the control system 502, which determines whether the cleaning device 10 is located at the correct horizontal level. In an embodiment, the horizontal angle sensor 522 includes a gyroscope or a G-sensor that is capable of obtaining the horizontal angle by measuring the direction of the force of gravity. The remote sensor 524 receives a wireless control signal from a remote transmitter 528 and causes the control system 502 to control the operation mode or movement route of the cleaning device 10 according to the control signal. The signal transmission means between the remote sensor 524 and the remote transmitter 528 may include infrared transmission or radio transmission, wherein the radio transmission may be ZigBee, Bluetooth, RFIO, Wi-Fi and FM.

The window edge sensor 526 serves the function of detecting the edge of a window. By using a sensing value transmitted by the window edge sensor 526, the control system 502 is able to detect an alien object at the edge of the flat object 101 or on the flat object 101. The window edge sensor 526 may be an analog sensor, e.g., an infrared, laser or ultrasonic distance sensor. The window edge sensor 526 may also be a limit switch or a proximity switch.

Figure 6:
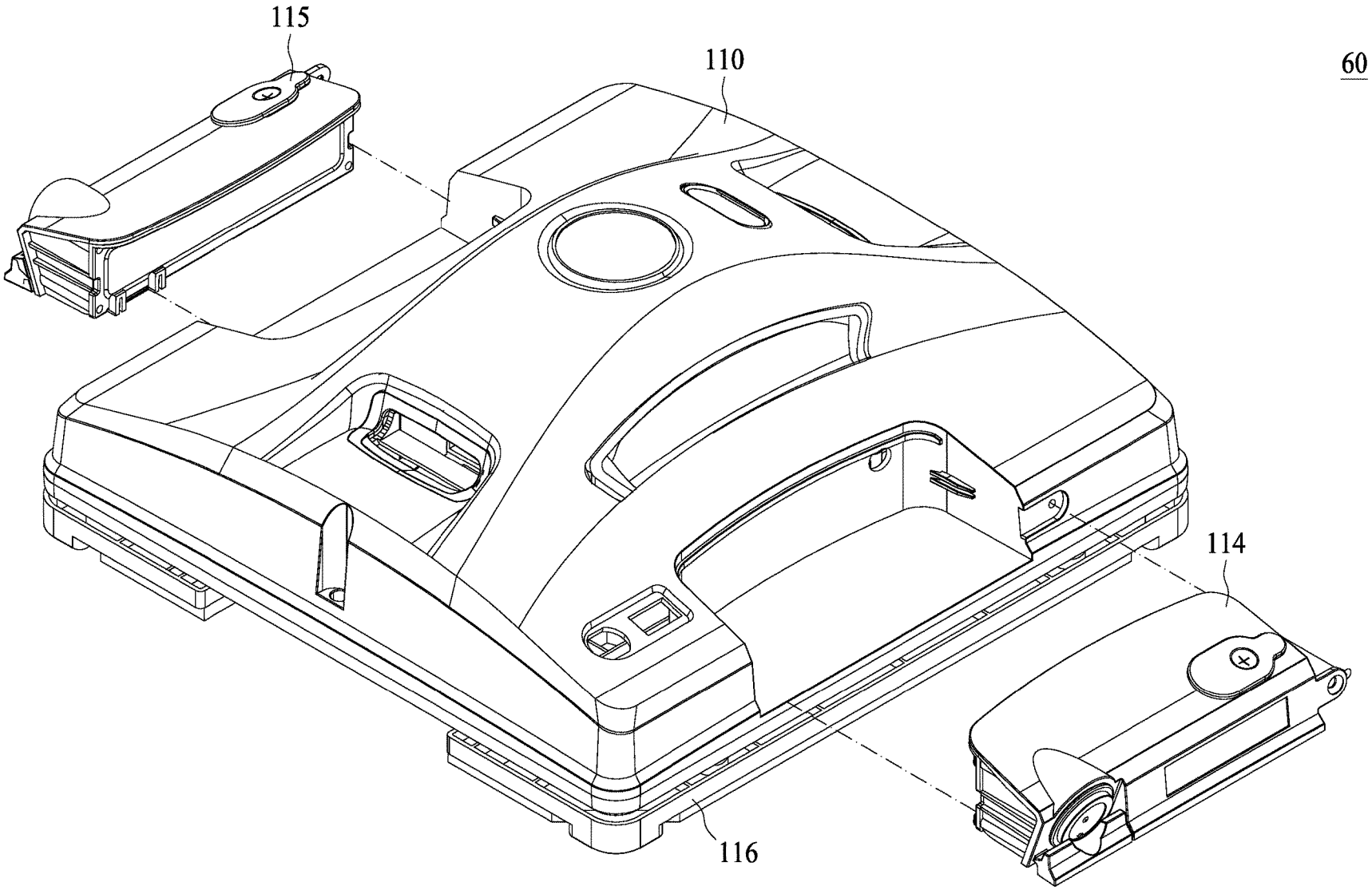
FIG. 6 is a schematic diagram of a cleaning device according to another embodiment of the present invention.

FIG. 6 is a schematic diagram of a cleaning device 60 according to another embodiment of the present invention. The cleaning device 60 includes a casing 110, a suction disk 116, a spray module (or a first spray module) 114 and a second spray module 115. Referring to FIG. 1 and FIG. 6, the structures and functions of same components (e.g., 110, 114 and 116) in the cleaning device 60 and the cleaning device 10 are substantially identical except for a major difference that the cleaning device 60 includes the second spray module 115. In an embodiment, the structure and function of the second spray module 115 are similar to those of the first spray module 114. In other embodiments, the first spray module 114 and the second spray module 115 may have different structures, e.g., the water drawing unit 308 of the first spray module 114 includes an ultrasonic vibration element whereas the water drawing unit 308 of the second spray module 115 is comprised of a pump. In an embodiment, the second spray module 115 and the first spray module 114 are disposed on opposite sides. However, in other embodiments, the second spray module 115 may be disposed on any side of the casing 110, e.g., on one side closer to the first spray module 114. In an embodiment, the orientations of the water outlets (e.g., 310 in FIG. 3A) of the first spray module 114 and the second spray module 115 coincide with the moving direction of the moving units 111 and 112 of the cleaning device 60. In an embodiment, the water outlet of the first spray module 114 is located on the side of the casing 110 and the water outlet of the second spray module 115 is located at a lower part of the casing 110 and faces the flat object 101.

According to an embodiment of the present invention, the cleaning device includes the spray module, which is capable of spraying a cleaning liquid while cleaning a flat object, which improves the cleaning performance. Further, since the suction disk 116 is configured to move relative to the casing 110, the suction disk 116 can move relative to the casing 110 when the moving units 111 and 112 run over an obstacle. Thus, the suction disk 116 is able to maintain a tight attachment to the flat object 101. Therefore, the airtightness of the airtight space defined by the flat object 101, the casing 110 and the suction disk 116 is maintained to prevent air leakage from the airtight space. In an embodiment, the area of the first region Aa defined by the border of the suction disk 116 is designed to be greater than the area of the second region Aw defined by the abutting portion of the suction disk 116. In addition, by appropriately configuring the proportions of the areas of the second region Aw and the remaining region Ac, the force resulting from the negative pressure and applied to the moving units 111 and 112 and the force resulting from the negative pressure and applied to the suction disk 116 can be managed.

The present invention provides multiple improved solutions for a cleaning device. The above improved solutions can be arbitrarily combined to provide an optimal cleaning effect. The illustrative and non-limiting embodiments in the disclosure of the present invention are exemplary for illustrating the structures and methods demonstrated. Therefore, any modifications made on the basis of the embodiments of the disclosure of the present invention are to be encompassed within the scope of the present invention. The orders and sequences of the steps of any procedure or method steps can be altered or reordered according to different embodiments. Without departing from the scope of the present invention, other replacements, alterations, changes and omissions may also be made to the designs, operation conditions and configurations of the embodiments.

What is claimed is:

1. A cleaning robot configured to move on an inclined or vertical surface, the cleaning robot comprising:

a casing;

a moving unit coupled to the casing;

a suction disk coupled to the casing, wherein during a cleaning operation the suction disk is configured to contact the surface, and the casing, the suction disk and the surface are configured to form an airtight space for allowing the cleaning robot to move on the surface without falling off due to gravity;

an air extraction module, disposed within the casing and in communication with the airtight space, configured to generate a negative pressure in the airtight space; and a spray module coupled to the casing, wherein the spray module comprises a water outlet provided on a side of the cleaning robot and configured to spray a liquid from the side of the cleaning robot onto the surface.

2. The cleaning robot according to claim 1, wherein a first region is defined by a border of the suction disk, a second region is defined by an area where the suction disk and the casing are in contact, an area inside the first region and outside the second region is defined as a remaining region, and forces of the negative pressure applied to the moving unit and the suction disk are determined according to an area of the second region and an area of the remaining region, respectively.

3. The cleaning robot according to claim 1, wherein the spray module comprises:

a water tank configured to store the liquid;

a water drawing unit configured to generate a driving force to discharge the liquid out of the water outlet.

4. The cleaning robot according to claim 3, wherein the water drawing unit comprises an ultrasonic vibration element.

5. The cleaning robot according to claim 4, wherein the ultrasonic vibration element comprises a substrate and a vibration plate connected to the substrate, the water outlet is disposed on the substrate, and the vibration plate laterally surrounds the water outlet.

6. The cleaning robot according to claim 5, wherein the vibration plate is made of a piezoelectric material.

7. The cleaning robot according to claim 4, wherein the water tank further comprises a waterproof component, the waterproof component and the water drawing unit being disposed on a side surface of the water tank, wherein the water outlet is disposed on the water drawing unit, and the water outlet is configured to spray the liquid from the side of the cleaning robot onto the surface, wherein the waterproof component laterally surrounds the water drawing unit and fills a gap between the water drawing unit and the water tank, and wherein the water drawing unit is offset from a central longitudinal axis of the side surface of the water tank.

8. The cleaning robot according to claim 7, wherein:

the cleaning robot is configured to sprayed the liquid in a direction in which the cleaning robot moves; and the water tank comprises a long edge and a short edge, wherein the long edge extends in a direction not parallel to the direction in which the liquid is sprayed.

9. The cleaning robot according to claim 8, wherein the spray module further comprises a water inlet provided on the water tank, and the water inlet and the water outlet are disposed on opposite sides of the long edge.

10. The cleaning robot according to claim 9, wherein the spray module is disposed on the side of the cleaning robot.

11. The cleaning robot according to claim 10, wherein the casing comprises an accommodation space on the side of the cleaning robot, and the spray module is disposed in the accommodation space and on the side of the cleaning robot.

12. The cleaning robot according to claim 7, wherein:

the water outlet is offset from the central longitudinal axis of the side surface of the water tank, the surface to be cleaned is partitioned into a first section and a second section, and the water outlet is aligned with the first section; and areas of the surface visited by the cleaning robot along adjacent paths at least partially overlap.

13. The cleaning robot according to claim 3, wherein the water drawing unit comprises a pump and the water outlet comprises a nozzle.

14. The cleaning robot according to claim 3, wherein the water outlet comprises an array of water outlet units.

15. The cleaning robot according to claim 3, wherein the spray module further comprises:

a water inlet disposed on the water tank; and a lid configured to cover the water inlet and comprising a recess and a split hole on the recess.

16. The cleaning robot according to claim 15, wherein the recess is located on an outer side of the lid.

17. The cleaning robot according to claim 3, wherein:

the water outlet is offset from a central longitudinal axis of a side surface of the water tank, the surface to be cleaned is partitioned into a first section and a second section, and the water outlet is aligned with the first section; and areas of the surface visited by the cleaning robot along adjacent paths at least partially overlap.

18. The cleaning robot according to claim 17, further comprising a cleaning cloth attached to the suction disk, wherein the cleaning robot is configured to:

cause the liquid to spray out of the water outlet onto the first section;

perform a first cleaning on the first section, wherein the liquid on the first section is substantially removed by a wetted region of the cleaning cloth; and perform a second cleaning on the first section by a dry region of the cleaning cloth.

19. The cleaning robot according to claim 17, wherein the water outlet is offset from the central longitudinal axis of the side surface of the water drawing unit.

20. The cleaning robot according to claim 3, wherein the water drawing unit comprises a substrate and a vibration plate connected to the substrate, and the water outlet is disposed on the substrate.

* * * * *